United States Patent [19]

Di Tella et al.

[11] Patent Number: 4,606,294

[45] Date of Patent: Aug. 19, 1986

[54] FIXED STRUCTURE MOORING SYSTEM FOR TANKER SHIPS

[75] Inventors: Vincenzo Di Tella; Roberto Brandi; Roberto Carraro, all of Padua, Italy

[73] Assignee: Tecnomare S.p.A., Venice, Italy

[21] Appl. No.: 588,459

[22] Filed: Mar. 12, 1984

[30] Foreign Application Priority Data

Mar. 14, 1983 [IT] Italy ..... 84105 A/83

[51] Int. Cl.[4] ..... E02B 17/00

[52] U.S. Cl. ..... 114/230; 441/5

[58] Field of Search ..... 441/3, 4, 5, 2; 114/230

[56] References Cited

U.S. PATENT DOCUMENTS 3,155,069 11/1964 Ross ..... 114/230
4,193,368 3/1980 De Graff ..... 114/230
4,286,898 9/1981 Stafford ..... 114/230
4,351,260 9/1982 Tuscon ..... 114/230

FOREIGN PATENT DOCUMENTS 8005142 4/1982 Netherlands ..... 114/230

*Primary Examiner*—Trygve M. Blix
*Assistant Examiner*—C. T. Bartz
*Attorney, Agent, or Firm*—Birch, Stewart, Kolasch & Birch

[57] ABSTRACT

An apparatus for reducing environmental forces on a mooring system for tanker ships, wherein a fixed structure comprising a hinged arm rotatably movable with respect to the mooring system is provided with a rocker assembly which is pivotally connected to said arm and universally connected via lateral connecting ties to ballast chambers.

4 Claims, 3 Drawing Figures

FIXED STRUCTURE MOORING SYSTEM FOR TANKER SHIPS

BACKGROUND OF THE INVENTION

The present invention relates to a system for permanently mooring a tanker ship on high seas by fixing it to a structure which emerges from the sea surface and has the following characteristics:

- the fixed structure is relieved from all of the motions of the ship and must thus bear only low frequency forces in addition to the shifting of the charging lines from the bottom to the surface so as to permit the use of rigid lines
- the recoil force is represented by ballast chambers or by a solid ballast
- nonfixed ("compliant", thus adaptable) structures are known which are capable of permanently mooring tanker ships.

These structures can be divided into:

(A) Towers with one or more articulated members to which the tanker ship is moored by a rigid arm;

(B) Buoys anchored to the sea bottom by one or more catenary lines and connected to the ship by a rigid arm;

(C) Catenary line systems directly connected to the ship's bow and supported by the ship herself.

A shortcoming of all these approaches is the necessity of employing flexible hoses for the flow of the oil. In the approaches (A) in order to overtake the articulated sections, in the (B) and (C) cases due to the lack of a fixed structural supporting member and also to allow the other flow lines to follow the ship's motion. Such flexible connections, especially when deep waters are encountered, are difficult to check and to maintain and require a periodical replacement.

The system according to the present invention does away with such drawbacks since it becomes possible to use rigid lines supported by a fixed structure and capable of transferring oil from the bottom to the surface.

The (A) and (B) systems, in addition, require high buoyancy volumes in the vicinity of the surface, the former system imparting stiffness to the assembly, to develop the recoil force and the latter system supporting the weight of the chains. On these volumes, both due to their superficial position or their position close to the sea surface and their dimensions, considerable wave forces and current are exerted thereto which load the entire structure and influence their dimensions.

The system described herein develops, on the contrary, its recoil force by exploiting ballast chambers which, due to their reduced size and their possibility of being positioned also in deep water are cheaper and are exposed to negligible environmental forces.

Also the dimensions of the foundations will become cheaper due to the fact that ballast chambers have been selected instead of buoyancy chambers.

The (C) systems, having no buoyancy chambers or buoyant component parts, because the weight of the anchoring cables is supported by the ship itself, do not present, obviously the latter mentioned drawback but it should nevertheless be noted that by such systems all the high-frequency motions of the ship are transferred to the anchoring cables and to the flow lines so that all these lines are subjected to considerable dynamic overloads. A description is now given of an embodiment of the present invention by way of example only and without limiting the possibility of introducing modifications which do not change the substance of the invention, reference being had to FIGS. 1, 2 and 3, wherein:

DESCRIPTION OF THE PREFERRED EMBODIMENTS

Figure 1:
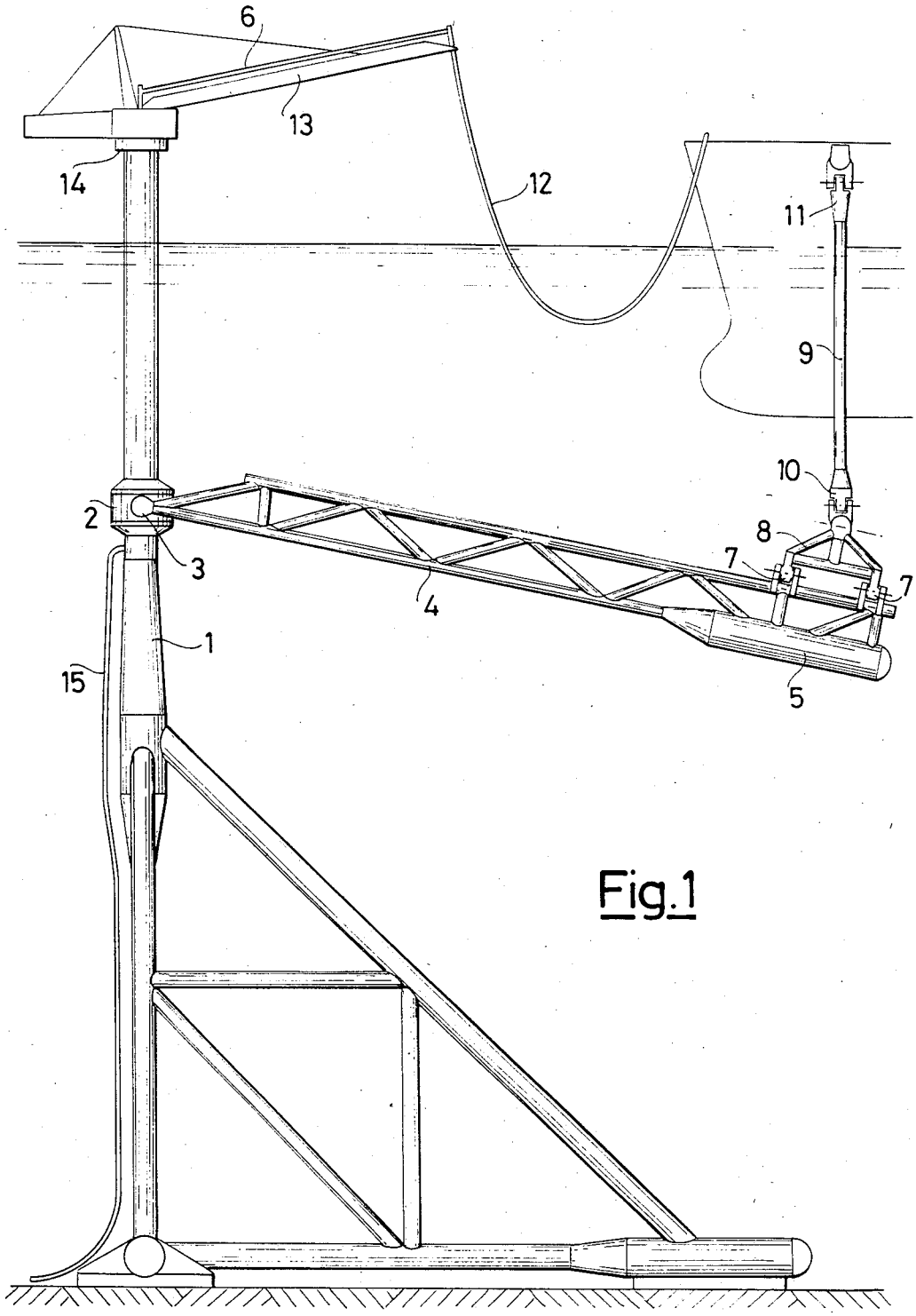
FIG. 1 is an overall view of the system
Figure 2:
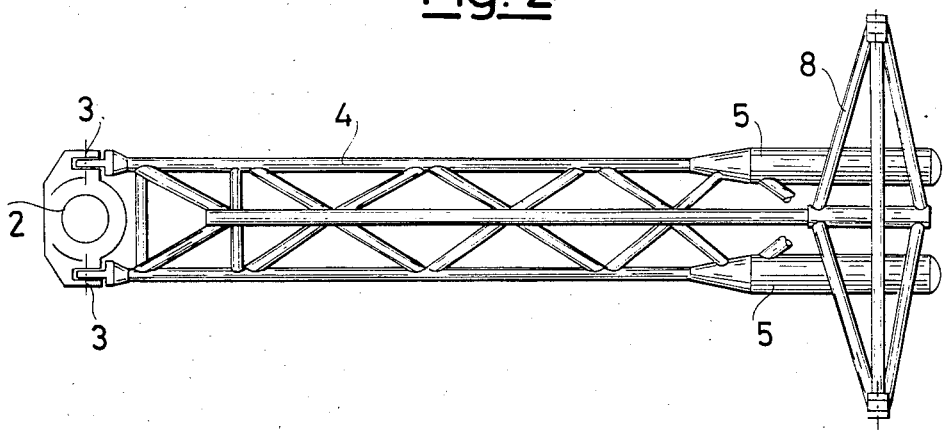
FIG. 2 is a plan view of the rigid arm of connection (4)
Figure 3:
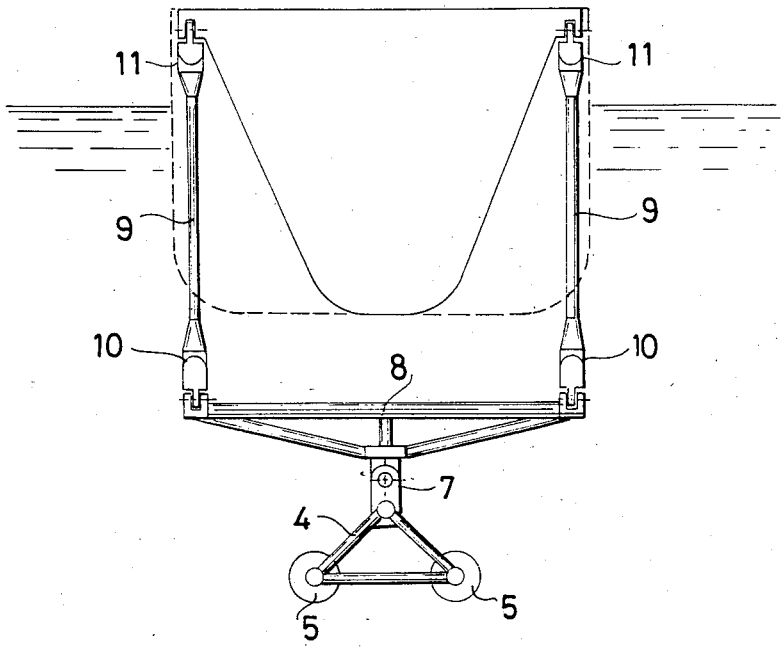
FIG. 3 is a cross-sectional view of the vertical plane which crosses the rigid connection arm (4).

The system is composed of a rigid arm (4) connected to a fixed structure (1), irrespective of the latter being with gravity foundation blocks or with poles, via two horizontal axis hinges (3) and a vertical axis supporting disc (2).

The arm (4) comprises one or more ballast chambers (5) capable of furnishing with their own weight the recoil force for the system. To the arm (4) there is connected, through the hinges (7) the rocker (8) necessary to disengage the arm from the rolling motions of the ship. The rocker is then connected to the ship by two studs (9). At each end of a stud (9) there is provided a Cardan joint (10) and a joint having three degrees of freedom (11).

The loading of the tanker ship takes place via rigid lines (6) (15) carried to the surface by the fixed structure and then connected to flexible hoses (12) or articulated arms, sustained by the lattice (13) which is pivoted to the rotatable supporting disc (14).

The principal advantages of the solution now described are:

- the selection of an emerged fixed structure permits the use of rigid flow lines for crude oil from the sea bottom to the sea level thus increasing the safety of the installation and limiting the necessity of inspection and replacement which are characteristic for the flexible hose lines;
- the possibility of connecting the mooring system to a low point of the fixed structure limits the stresses on the latter and also reduces the environmental forces both on the mooring structure and the fixed structure and mainly on the arm and the ballast chambers;
- the use of ballast chambers or solid ballast instead of buoyancy chambers to develop the recoil force, limits the dimensions and the costs of the chambers and consequently the environmental forces thereon.

We claim:

1. An apparatus for mooring tanker ships in the water which comprises

- a fixed structure extending from the bottom to above the surface of the water,
- a hinged arm member extending from the fixed structure at a location below the surface of the water, one end portion of said hinged arm member being rotatably, movably attached to said fixed structure,
- a rocker assembly pivotally connected to the other end portion of said hinged arm member, said rocker arm assembly containing arm members which extend outwardly from said hinged arm member, and
- lateral tie members having one end thereof connected at a location below the surface of the water by pivot members to the end portions of the arm members of said rocker assembly, the other ends of said lateral tie members adapted to be hinged to opposite sides of the tanker ship, above the surface of the water.

2. The apparatus of claim 1 wherein ballast chambers are attached to the end portion of the arm member.

3. The apparatus of claim 1 wherein the fixed structure is adapted to carry rigid flow lines which extend from the water bottom to sea level.

4. The apparatus of claim 1 wherein the end portions of each lateral tie member, opposite from said rocker assembly is provided with a joint member for connection of the arm member to a ship.

* * * * *